US008006411B2

(12) United States Patent
Manz et al.

(10) Patent No.: US 8,006,411 B2
(45) **Date of Patent: *Aug. 30, 2011**

(54) BALL AND SOCKET 3D CUSHIONING SYSTEM

(75) Inventors: Gerd Rainer Manz, Weisendorf (DE); Timothy David Lucas, Erlangen (DE)

(73) Assignee: adidas International Marketing B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 12/702,731

(22) Filed: Feb. 9, 2010

(65) Prior Publication Data

US 2010/0139120 A1 Jun. 10, 2010

Related U.S. Application Data

(63) Continuation of application No. 11/774,898, filed on Jul. 9, 2007, now Pat. No. 7,665,232, which is a continuation of application No. 11/251,141, filed on Oct. 14, 2005, now Pat. No. 7,243,445, which is a continuation of application No. 10/914,387, filed on Aug. 9, 2004, now Pat. No. 6,983,557, which is a continuation of application No. 10/340,880, filed on Jan. 10, 2003, now Pat. No. 6,823,612.

(30) Foreign Application Priority Data

Sep. 24, 2002 (DE) ..... 102 44 433

(51) Int. Cl.
*A43B 13/00* (2006.01)
*A43B 13/14* (2006.01)

(52) U.S. Cl. ..... 36/103; 36/25 R; 36/27

(58) Field of Classification Search ..... 36/103, 36/25 R, 27, 116, 126, 128, 39, 7.8, 8.3, 61
See application file for complete search history.

(56) References Cited

U.S. PATENT DOCUMENTS 887,752 A 5/1908 Beck et al.
1,165,235 A 12/1915 Emery
(Continued)

FOREIGN PATENT DOCUMENTS

DE 4114551 5/1992
(Continued)

OTHER PUBLICATIONS

European Search Report for WO 01/70064 (Oct. 3, 2001).
(Continued)

*Primary Examiner* — Ted Kavanaugh
(74) *Attorney, Agent, or Firm* — Kilpatrick Townsend & Stockton LLP

(57) ABSTRACT

The invention relates to a sliding element for a shoe sole. The sliding element includes an upper sliding surface and a lower sliding surface, wherein the lower sliding surface is arranged below the upper sliding surface so as to be slideable in at least two directions. The upper sliding surface can form a lower side of an upper heel cup and the lower sliding surface can form an upper side of a lower heel cup, wherein the upper heel cup and the lower heel cup have corresponding substantially spherical shapes. Complex multi-dimensional sliding and cushioning movements between the upper sliding surface and the lower sliding surface are made possible by the corresponding three-dimensional shapes of the two substantially spherical surfaces.

19 Claims, 3 Drawing Sheets

U.S. PATENT DOCUMENTS

| | | | |
|---|---|---|---|
| 1,888,617 | A | 11/1932 | Basilio |
| 2,535,102 | A | 12/1950 | Taylor |
| 2,668,373 | A | 2/1954 | Russo |
| 2,700,832 | A | 2/1955 | Slovinski |
| 2,802,285 | A | 8/1957 | Griffin |
| 2,908,983 | A | 10/1959 | Berke |
| 2,931,110 | A | 4/1960 | Pietrocola |
| 3,251,076 | A | 5/1966 | Burke |
| 3,477,150 | A | 11/1969 | Shepherd |
| 3,478,447 | A | 11/1969 | Gillead |
| 3,631,614 | A | 1/1972 | Rice |
| 3,782,011 | A | 1/1974 | Fisher |
| 4,196,903 | A | 4/1980 | Illustrato |
| 4,262,434 | A | 4/1981 | Michelotti |
| 4,364,188 | A | 12/1982 | Turner et al. |
| 4,411,076 | A | 10/1983 | Wilkinson |
| 4,843,735 | A | 7/1989 | Nakanishi et al. |
| 4,956,927 | A | 9/1990 | Misevich et al. |
| D312,723 | S | 12/1990 | Okada et al. |
| 5,138,776 | A | 8/1992 | Levin et al. |
| 5,224,278 | A | 7/1993 | Jeon et al. |
| 5,224,810 | A | 7/1993 | Pitkin |
| 5,233,767 | A | 8/1993 | Kramer |
| 5,279,051 | A | 1/1994 | Whatley |
| 5,309,651 | A | 5/1994 | Handel |
| 5,337,492 | A | 8/1994 | Anderie et al. |
| 5,343,639 | A | 9/1994 | Kilgore et al. |
| 5,353,523 | A | 10/1994 | Kilgore et al. |
| 5,373,649 | A | 12/1994 | Choi |
| 5,456,026 | A | 10/1995 | Lewis |
| 5,493,791 | A | 2/1996 | Kramer |
| 5,517,770 | A | 5/1996 | Martin et al. |
| 5,560,126 | A | 10/1996 | Meschan et al. |
| 5,572,804 | A | 11/1996 | Skaja et al. |
| 5,607,749 | A | 3/1997 | Strumor |
| D385,393 | S | 10/1997 | Wong et al. |
| 5,689,902 | A | 11/1997 | Juang et al. |
| 5,752,329 | A | 5/1998 | Horibata et al. |
| 5,832,629 | A | 11/1998 | Wen et al. |
| 5,853,844 | A | 12/1998 | Wen et al. |
| 5,881,478 | A | 3/1999 | McMahon et al. |
| 5,933,983 | A | 8/1999 | Jeon et al. |
| 5,937,544 | A | 8/1999 | Russell |
| 5,983,529 | A | 11/1999 | Serna |
| 6,006,449 | A | 12/1999 | Orlowski et al. |
| 6,023,859 | A | 2/2000 | Burke et al. |
| 6,050,002 | A | 4/2000 | Meschan |
| D424,794 | S | 5/2000 | Garcia et al. |
| 6,055,747 | A | 5/2000 | Lombardino |
| 6,058,627 | A | 5/2000 | Violette et al. |
| 6,082,023 | A | 7/2000 | Dalton |
| D429,877 | S | 8/2000 | Lozano et al. |
| 6,098,313 | A | 8/2000 | Skaja |
| 6,115,943 | A | 9/2000 | Gyr |
| D431,898 | S | 10/2000 | Clegg et al. |
| 6,125,557 | A | 10/2000 | Brown |
| 6,131,310 | A | 10/2000 | Fang et al. |
| D433,216 | S | 11/2000 | Avar et al. |
| 6,195,915 | B1 | 3/2001 | Russell |
| 6,195,920 | B1 | 3/2001 | Morris et al. |
| 6,205,682 | B1 | 3/2001 | Park et al. |
| 6,205,684 | B1 | 3/2001 | Snyder |
| 6,266,898 | B1 | 7/2001 | Cheng et al. |
| D446,923 | S | 8/2001 | McCourt |
| D450,437 | S | 11/2001 | Simpson et al. |
| 6,327,795 | B1 | 12/2001 | Russell |
| 6,330,757 | B1 | 12/2001 | Russell |
| 6,393,731 | B1 | 5/2002 | Moua et al. |
| 6,416,610 | B1 | 7/2002 | Matis et al. |
| 6,708,426 | B2 | 3/2004 | Erickson et al. |
| 6,751,891 | B2 | 6/2004 | Lombardino |
| 6,823,612 | B2 | 11/2004 | Manz et al. |
| 6,962,008 | B2 | 11/2005 | Manz et al. |
| 6,983,557 | B2 | 1/2006 | Manz et al. |
| 7,010,869 | B1 * | 3/2006 | Ellis, III ..... 36/25 R |
| 7,140,124 | B2 | 11/2006 | Manz et al. |
| 7,243,445 | B2 | 7/2007 | Manz et al. |
| 7,665,232 | B2 * | 2/2010 | Manz et al. ..... 36/103 |
| 2001/0010129 | A1 | 8/2001 | Russell |
| 2001/0018806 | A1 | 9/2001 | Snyder |
| 2001/0034957 | A1 | 11/2001 | Doerer et al. |
| 2002/0023374 | A1 | 2/2002 | Russell |
| 2002/0088140 | A1 | 7/2002 | Wang et al. |

FOREIGN PATENT DOCUMENTS

| | | |
|---|---|---|
| DE | 19955550 | 12/2000 |
| EP | 0510943 | 10/1992 |
| GB | 2221378 | 2/1990 |
| GB | 2273037 | 6/1994 |
| WO | WO-9807343 | 2/1998 |
| WO | WO-0170064 | 9/2001 |

OTHER PUBLICATIONS

Photo of Reebok's Premier Series Shoes and English language translation of texts.

European Search Report for Application No. EP 10 012973, mailed from the European Patent Office on Apr. 4, 2011 (6 pages).

* cited by examiner

BALL AND SOCKET 3D CUSHIONING SYSTEM

CROSS-REFERENCE TO RELATED APPLICATION

This application incorporates by reference herein in their entireties, and is a continuation of U.S. application Ser. No. 11/774,898, entitled "Ball and Socket 3D Cushioning System," filed on Jul. 9, 2007, now U.S. Pat. No. 7,665,232; which is a continuation of U.S. application Ser. No. 11/251,141, entitled "Ball and Socket 3D Cushioning System," filed on Oct. 14, 2005, now U.S. Pat. No. 7,243,445; which is a continuation of U.S. application Ser. No. 10/914,387, entitled "Ball and Socket 3D Cushioning System," filed on Aug. 9, 2004, now U.S. Pat. No. 6,983,557; which is a continuation of U.S. application Ser. No. 10/340,880, entitled "Ball and Socket 3D Cushioning System," filed on Jan. 10, 2003, now U.S. Pat. No. 6,823,612, which incorporates by reference, and claims priority to and the benefit of, German patent application serial number 10244433.1 that was filed on Sep. 24, 2002.

TECHNICAL FIELD

The present invention relates to a sliding element for a shoe sole, in particular a shoe sole with a sliding element that provides cushioning to the shoe in three dimensions.

BACKGROUND

Shoe soles should primarily meet two requirements. First, they should provide good friction with the ground. Second, they should sufficiently cushion the ground reaction forces arising during a step cycle to reduce the strains on the wearer's muscles and bones. These ground reaction forces can be classified into three mutually orthogonal components, i.e., a component occurring in each of the X-direction, the Y-direction, and the Z-direction. The Z-direction designates a dimension essentially perpendicular (or vertical) to the ground surface. The Y-direction designates a dimension essentially parallel to a longitudinal axis of a foot and essentially horizontal relative to the ground surface. The X-direction designates a dimension essentially perpendicular to the longitudinal axis of the foot and essentially horizontal relative to the ground surface.

The largest ground reaction force component typically occurs in the Z-direction. Studies have shown that peak forces of approximately 2000 N may occur in the Z-direction during running. This value is about 2.5 to 3 times the body weight of a typical runner. Accordingly, in the past, the greatest attention was directed to the strains of the muscles and the bones caused by this force component and the many different arrangements for optimizing the cushioning properties of a shoe in the Z-direction.

Ground reaction forces, however, further include noticeable force components in the X-direction and in the Y-direction. Measurements have shown that forces of approximately 50 N in the X-direction and of approximately 250 N in the Y-direction may occur in a heel area during running. During other sports, for example lateral sports such as basketball or tennis, forces of up to 1000 N may occur in a forefoot area in the X-direction during side cuts, impact, and push off.

The aforementioned horizontal forces in the X- and Y-directions are one reason why running on an asphalt road is considered uncomfortable. When the shoe contacts the ground, its horizontal movement is essentially completely stopped within a fraction of a second. In this situation, the horizontally effective forces, i.e., the horizontal transfer of momentum, are very large. This is in contrast to running on a soft forest ground, where the deceleration is distributed over a longer time period due to the reduced friction of the ground. The high transfer of momentum can cause premature fatigue of the joints and the muscles and may, in the worst case, even be the reason for injuries.

Further, many runners contact the ground with the heel first. If viewed from the side, the longitudinal axis of the foot is slightly inclined with respect to the ground surface (i.e., dorsal flexion occurs). As a result, a torque, which cannot be sufficiently cushioned by compression of a sole material in the Z-direction alone, is exerted on the foot during first ground contact. This problem becomes worse when the runner runs on a downhill path, since the angle between the shoe sole and the ground increases in such a situation.

In addition, road surfaces are typically cambered for better water drainage. This leads to a further angle between the sole surface and the ground plane. Additional loads, caused by a torque on the joints and the muscles, are, therefore, created during ground contact with the heel. With respect to this strain, the compression of the sole materials in the Z-direction alone again fails to provide sufficient cushioning. Furthermore, during trail running on soft forest ground, roots or similar bumps in the ground force the foot during ground contact into an anatomically adverse inclined orientation. This situation leads to peak loads on the joints.

There have been approaches in the field to effectively cushion loads that are not exclusively acting in the Z-direction. For example, International Publication No. WO98/07343, the disclosure of which is hereby incorporated herein by reference in its entirety, discloses 3D-deformation elements that allow for a shift of the overall shoe sole with respect to a ground contacting surface. This is achieved by a shearing motion of an elastic chamber, where the walls are bent to one side in parallel so that the chamber has a parallelogram-like cross-section, instead of its original rectangular cross-section, under a horizontal load.

A similar approach can be found in U.S. Pat. No. 6,115,943, the disclosure of which is hereby incorporated herein by reference in its entirety. Two plates interconnected by means of a rigid linkage below the heel are shifted with respect to each other. The kinematics are similar to International Publication No. WO98/07343, i.e., the volume defined by the upper and lower plate, which is filled by a cushioning material, has an approximately rectangular cross-section in the starting configuration, but is transformed into an increasingly thin parallelogram under increasing deformation.

One disadvantage of such constructions is that cushioning is only possible along a single path, as predetermined by the mechanical elements. For example, the heel unit disclosed in U.S. Pat. No. 6,115,943 allows only a deflection in the Y-direction, which is simultaneously coupled to a certain deflection in the Z-direction. With respect to forces acting in the X-direction, the sole is substantially rigid. Another disadvantage of such constructions is that the horizontal cushioning is not decoupled from the cushioning in the Z-direction. Modifications of the material or design parameters for the Z-direction can have side effects for the horizontal directions and vice versa. Accordingly, the complex multi-dimensional loads occurring during the first ground contact with the heel, in particular in the above discussed situations with inclined road surfaces, cannot be sufficiently controlled.

Further, U.S. Pat. No. 5,224,810, the disclosure of which is also hereby incorporated herein by reference in its entirety, discloses dividing the overall sole of a shoe into two wedgelike halves which are shifted with respect to each other, wherein the movement is limited to the X-direction by means of corresponding ribs. Cushioning for ground reaction forces acting in the longitudinal direction (i.e., the Y-direction) of the shoe is not disclosed. In particular, the system does not provide any cushioning during ground contact with the heel.

It is, therefore, an object of the present invention to provide a cushioning element for a shoe sole that reduces loads on the muscles and the bones caused by multi-dimensional ground reaction forces, in particular during the first ground contact with the heel, thereby overcoming the above discussed disadvantages of the prior art.

SUMMARY OF THE INVENTION

The present invention relates to a sliding element for a shoe sole, in particular a sports shoe with an upper sliding surface and a lower sliding surface, wherein the lower sliding surface is arranged below the upper sliding surface so as to be slideable in at least two directions. A relative movement between the upper sliding surface and the lower sliding surface allows the foot to feel as if it is wearing a conventional shoe that contacts a surface with reduced friction, for example a soft forest ground. The sliding movement of the surfaces distributes the deceleration of the sole over a greater time period. This, in turn, reduces the amount of force acting on the athlete and the momentum transfer on the muscles and the bones.

The corresponding three-dimensional shapes of the upper and lower sliding surfaces make possible a multi-directional sliding movement between the upper and lower sliding surfaces. Complex multi-dimensional cushioning movements are possible, which are preferred during ground contact with the heel, rather than exclusive compression in the Z-direction.

In addition, a sliding element in accordance with the invention positively influences the moments and forces arising during running on cambered roads and during downhill running. A comparative study with conventional sole structures has shown that the sliding element allows measurable deflections, which noticeably reduce the loads arising during ground contact.

In one aspect, the invention relates to a sliding element for a shoe sole. The sliding element includes an upper sliding surface and a lower sliding surface. The lower sliding surface is arranged below the upper sliding surface, such as to be slideable in at least two directions.

In another aspect, the invention relates to a sole for an article of footwear. The sole includes a sliding element, which itself includes an upper sliding surface and a lower sliding surface. The lower sliding surface is arranged below the upper sliding surface, such as to be slideable in at least two directions.

In yet another aspect, the invention relates to an article of footwear including an upper and a sole. The sole includes a sliding element, which itself includes an upper sliding surface and a lower sliding surface. The lower sliding surface is arranged below the upper sliding surface, such as to be slideable in at least two directions.

In various embodiments of the foregoing aspects of the invention, the sliding element can include a spring element that is deflected by a sliding movement of the upper sliding surface relative to the lower sliding surface. The spring element can be pre-tensioned when the upper sliding surface and the lower sliding surface are in a neutral position and can include at least one elastic pin connecting the upper sliding surface to the lower sliding surface. An enlarged area may be included at each end of the elastic pin. Moreover, one enlarged end of the elastic pin may extend at least partially through an opening defined by the upper sliding surface and the other enlarged end of the pin may extend at least partially through an opening defined by the lower sliding surface. In one embodiment, the lower sliding surface is slideable relative to the upper sliding surface in at least three directions.

In another embodiment, the upper sliding surface forms a lower side of an upper heel cup and the lower sliding surface forms an upper side of a lower heel cup. The upper heel cup and the lower heel cup can include corresponding substantially spherical surfaces. In yet another embodiment, the sliding element can include a seal disposed at least partially about the upper sliding surface and the lower sliding surface to seal an intermediate space between the upper sliding surface and the lower sliding surface. Additionally, one of the sliding surfaces can include at least one projection for engaging a recess defined by the other sliding surface.

In still other embodiments, the upper heel cup can be coupled to a midsole of the sole and a separate heel sole unit may be coupled to the lower heel cup. The upper heel cup can extend along at least one of a medial and a lateral side into a midfoot area of the sole. The separate heel sole unit can include a midsole layer and an outsole layer.

In still another aspect, the invention relates to a cushioning system for an article of footwear. The cushioning system includes a ball joint disposed in at least one of a heel area and a forefoot area of the article of footwear. The ball joint includes at least a portion of a socket and at least a portion of a ball disposed at least partially within the socket, wherein the ball and socket are in slideable contact.

These and other objects, along with the advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

The drawings are not necessarily to scale, emphasis instead generally being placed upon illustrating the principles of the invention. In the following description, various embodiments of the present invention are described with reference to the following drawings, in which.

DETAILED DESCRIPTION OF THE INVENTION

Embodiments of the present invention are described below. It is, however, expressly noted that the present invention is not limited to these embodiments, but rather the intention is that modifications that are apparent to the person skilled in the art are also included. In particular, the present invention is not intended to be limited to soles for sports shoes, but rather it is to be understood that the present invention can also be used to produce soles or portions thereof for any article of footwear. Further, only a left or right sole and/or shoe is depicted in any given figure; however, it is to be understood that the left and right soles/shoes are typically mirror images of each other and the description applies to both left and right soles/shoes. In certain activities that require different left and right shoe configurations or performance characteristics, the shoes need not be mirror images of each other.

Figure 1:
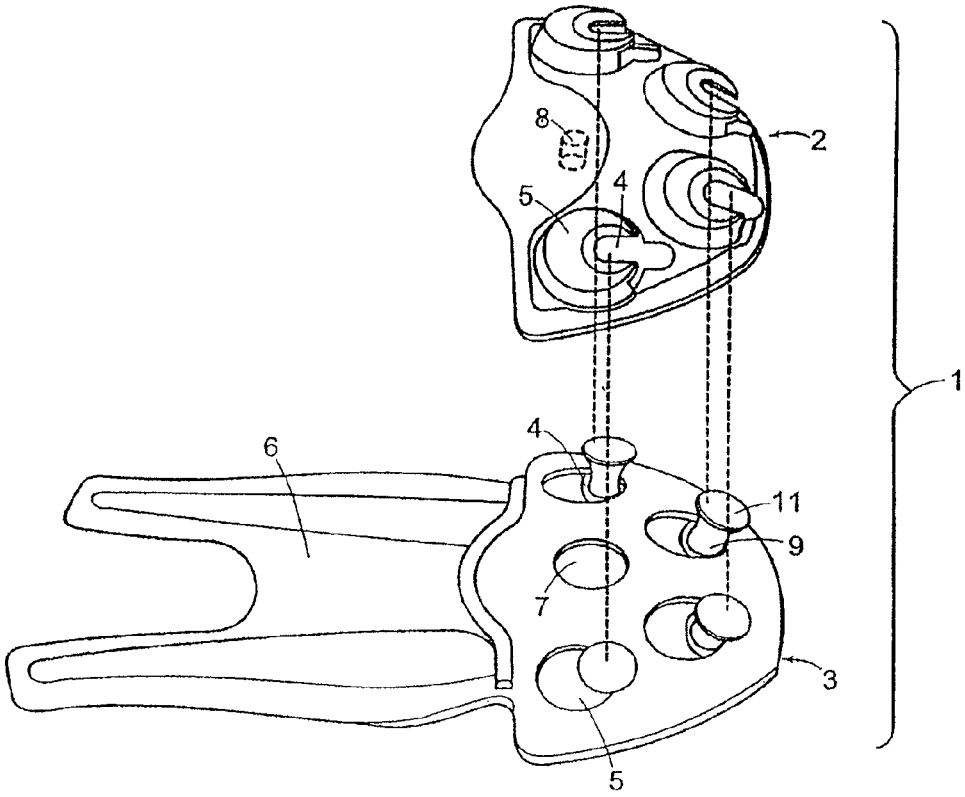
FIG. 1 is an exploded schematic perspective bottom view of a sliding element in accordance with the invention incorporating a lower heel cup and an upper heel cup.

FIG. 1 depicts one embodiment of a sliding element 1 in accordance with the invention. The sliding element 1 includes a lower sliding surface in the form of a lower heel cup 2 and an upper sliding surface in the form of an upper heel cup 3. In FIGS. 1-4 and 7, a bottom view is illustrated. The upper heel cup 3 and the lower heel cup 2, which are each defined with respect to a shoe in an upright orientation, therefore appear in FIGS. 1 and 4 in an inverted arrangement.

In one embodiment, to reduce wear on one or both cups 2, 3, the lower heel cup 2 and the upper heel cup 3 may be made from materials having good sliding properties. Suitable plastic materials, as well as metals with a suitable coating, such as the Teflon® (polytetrafluoroethylene (PTFE)) brand sold by DuPont or a similar substance, may be used. Besides plastic or polymeric materials and coated metals, it is also possible to coat plastic materials with Teflon® or to compound Teflon® directly into the plastic material. Possible materials and manufacturing techniques are described in greater detail hereinbelow.

As shown in FIG. 1, the lower heel cup 2, as well as the upper heel cup 3, comprise a curvature which substantially corresponds to the lower side of a typical wearer's heel. This curvature approximates a section of a surface of a sphere. When the lower heel cup 2 slides along the upper heel cup 3, its movement therefore extends along this spherical surface. Much like a ball joint or a ball and socket type arrangement, the upper heel cup 3 forms at least a portion of the ball and the lower heel cup 2 forms at least a portion of the socket. The spherical surface is particularly well adapted to cushion the ground reaction forces occurring during the above described inclined ground contact with the heel. Through a sliding movement of the lower heel cup 2 relative to the upper heel cup 3 along the spherical surface, a heel area 52 (see FIG. 4) of a shoe sole 50 (see FIG. 4) provided with such a sliding element 1 may, to a certain extent, yield under the arising torque. The cushioning effect may take place along any arbitrary trajectory on the surface of the substantially spherically-shaped lower heel cup 2 and upper heel cup 3. A specific rotational freedom during the impact phase (i.e., the phase when the heel is loaded) is allowed. The transmission of the usual torsional forces from the foot to the knee does not occur or occurs only in a limited manner.

Recesses 5 may be arranged both on the lower heel cup 2 and on the upper heel cup 3. Slits 4 may be arranged in the recesses 5 of both the lower heel cup 2 and the upper heel cup 3. To provide a long-lasting cushioning system for the sliding movement of lower heel cup 2 relative to the upper heel cup 3, one or more spring elements 9, which can be very simply and cost-efficiently produced and assembled, may be arranged between the lower heel cup 2 and the upper heel cup 3. One end 11 of the spring element 9 is placed in a slit 4 of the lower heel cup 2, while the other end of the spring element 9 is placed in a slit 4 of the upper heel cup 3. In one embodiment, the spring element 9 is an elastic pin 10 (see FIG. 6).

As shown in FIG. 1, four recesses 5 and corresponding spring elements 9 are spaced relatively evenly about the outer spherical surface of the lower heel cup 2, relative to a common center point, to most evenly distribute the cushioning properties of the sliding element 1. Alternatively, the four recesses 5 and corresponding spring elements 9, or any other number of these components, may be spaced in any arrangement about the spherical surface of the lower heel cup 2 and the upper heel cup 3.

Figure 5:
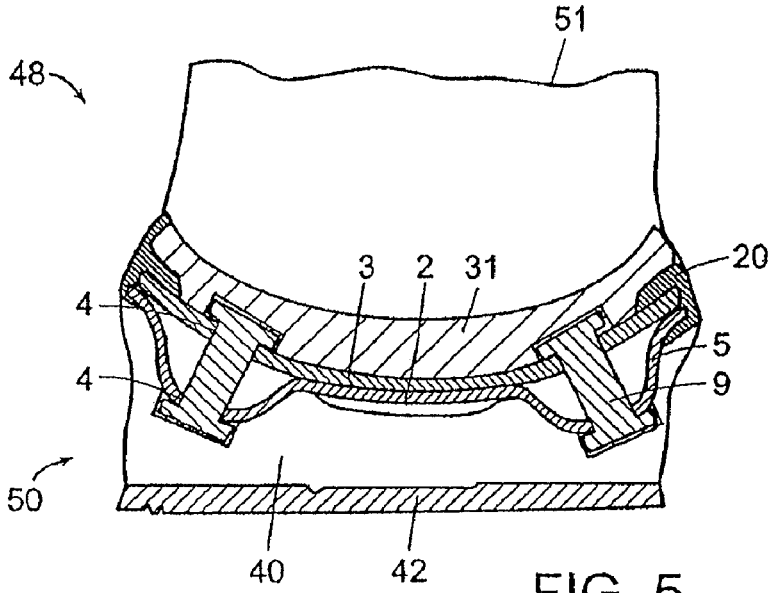
FIG. 5 is a cross-sectional schematic view of the shoe sole of FIG. 4 taken at line 5-5.
Figure 6:
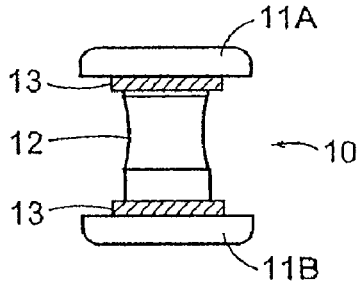
FIG. 6 is a schematic plan view of an elastic pin for providing an elastic force to a sliding element in accordance with the invention.

FIG. 6 depicts one embodiment of an elastic pin 10 in accordance with the invention. The pin 10 includes, at each of its lower and upper ends, an enlarged area 11A, 11B. One of the enlarged areas 11A anchors the pin 10 to one recess 5 of the lower heel cup 2, via slit 4, and the other enlarged area 11B anchors the pin 10 to a corresponding recess 5 of the upper heel cup 3, via corresponding slit 4. The lower heel cup 2 is, therefore, maintained in close contact with the upper heel cup 3, as shown in FIG. 5.

Referring again to FIG. 6, the pin 10 may have a variety of lengths. A longer pin 10 allows for greater elastic elongation in absolute terms and thereby a greater range of deformation of the lower heel cup 2 relative to the upper heel cup 3. The elasticity, and thereby the deformation properties, of the sliding element 1 can be adjusted by varying the amount of tapering in the central part 12 of the pin 10. The tapering assures that the elastic elongation occurs in the central part 12 of the pin 10 and thus reduces the load on the enlarged areas 11A, 11B of the pin 10.

Figure 4:
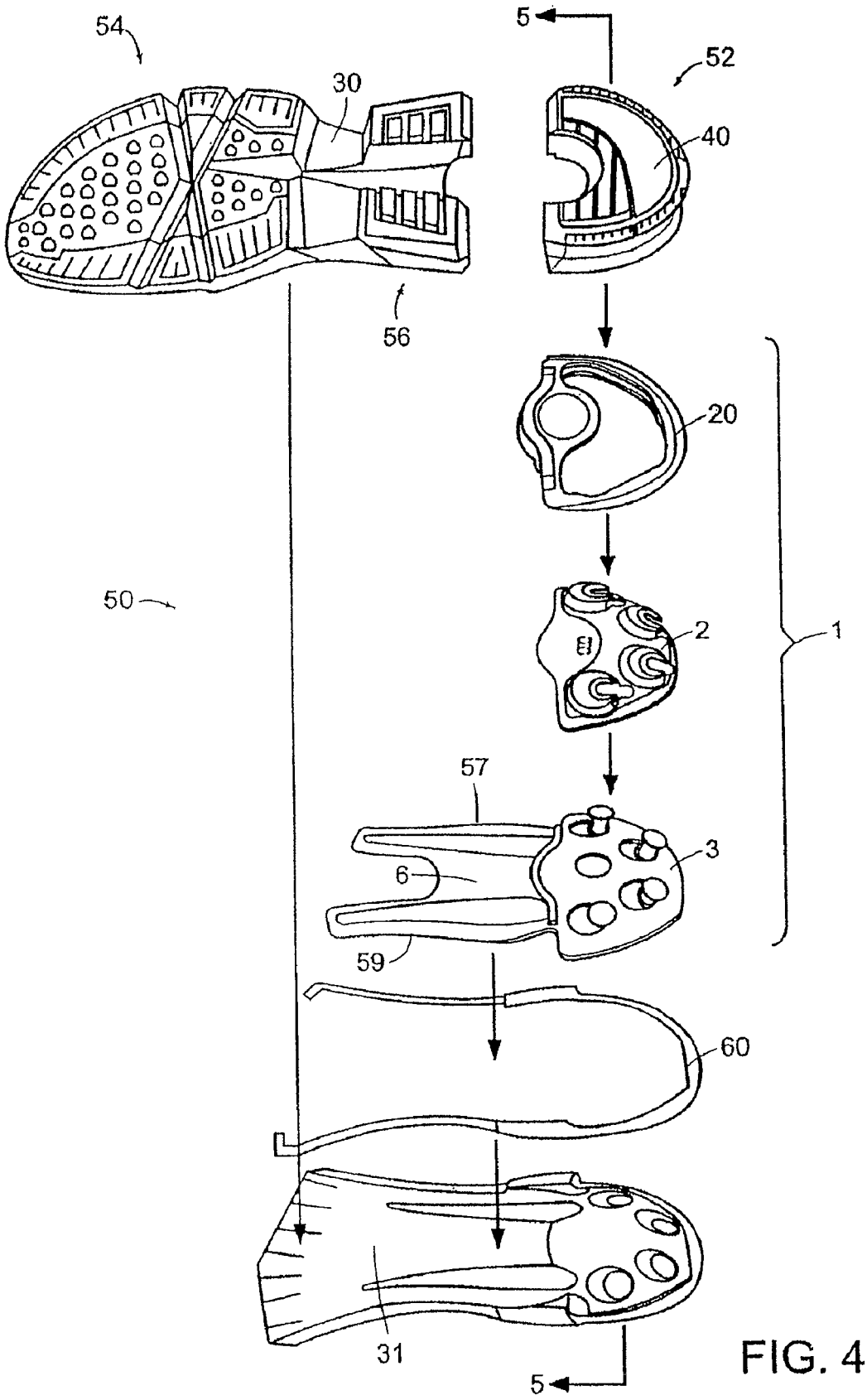
FIG. 4 is an exploded schematic view of a shoe sole with the sliding element, seal, and heel sole element shown in FIGS. 1-3, respectively.

To avoid relative deflection between the lower heel cup 2 and the upper heel cup 3 that is too easy, the elastic pins 10 may be pre-tensioned, radially and frontally, when the lower heel cup 2 and the upper heel cup 3 are in a neutral position, i.e., substantially positioned above one another (see FIG. 5). This provides a desired amount of restoring force and assures the necessary deformation stability of the heel area 52 when the sliding element 1 is used in a shoe sole 50 (see FIG. 4). To increase the pre-tension, optional, relatively small washers 13 may, during assembly, be inserted directly beside the enlarged areas 11A, 11B of the pins 10. The resulting elongation of the pins 10, even in the neutral or starting position of the lower heel cup 2 and the upper heel cup 3, causes a defined spring tension, i.e., greater elastic resistance to relative movement. Adjusting the pretension of the pins 10 is, therefore, a further way to selectively tune the cushioning properties of the sliding element 1.

Referring again to FIG. 1, the cushioning movement of the lower heel cup 2 and the upper heel cup 3 may be limited by arranging a small projection 8 on the lower heel cup 2 for engaging a recess or cutout 7 in the upper heel cup 3. Alternatively, the projection 8 could be arranged on the upper heel cup 3 for engaging a recess or cutout 7 in the lower heel cup 2. In addition, multiple projections 8 could be arranged on the lower heel cup 2 or the upper heel cup 3 for engaging multiple recesses or cutouts 7 on the upper heel cup 3 or the lower heel cup 2, respectively. The form and the extension of the projections 8 relative to the recesses or cutouts 7 and the resulting play can limit the direction and the maximum amount of deflection of the lower heel cup 2 relative to the upper heel cup 3. Further, the size and shape of the recess(es) 7 will also impact the direction and amount of deflection possible and can be selected to suit a particular application.

Figure 2:
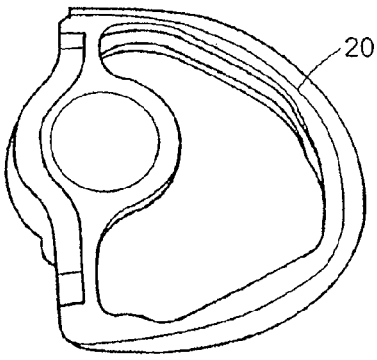
FIG. 2 is a schematic perspective view of a seal for sealing the lower heel cup and the upper heel cup of FIG. 1.

FIG. 2 depicts one embodiment of a seal 20 in accordance with the invention. In the assembled state of the sliding element 1, the seal 20 encompasses the lower heel cup 2 and the upper heel cup 3 (see also FIG. 5). The seal 20 prevents dirt from penetrating the intermediate space between the lower heel cup 2 and the upper heel cup 3 and impairing the sliding movement of the lower heel cup 2 relative to the upper heel cup 3. By selecting a suitable material and geometry, the seal 20 may provide an additional restoring force in response to relative movements of the lower heel cup 2 and the upper heel cup 3.

Figure 3:
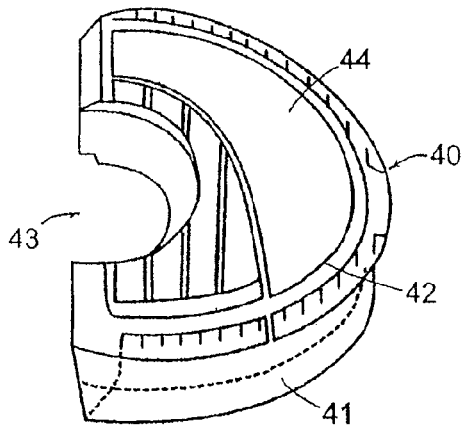
FIG. 3 is a schematic perspective view of a heel sole element to be attached to the lower heel cup of FIG. 1.

FIG. 3 depicts one embodiment of a separate heel sole unit 40 in accordance with the invention. As explained with reference to FIG. 7 in more detail later, the separate heel sole unit 40 is independently moveable with respect to a separate lower sole body 30 (see also FIG. 4). The heel sole unit 40 may be arranged below the lower heel cup 2 to transmit, to the ground contacting surface of the shoe sole 50, the relative movements of the lower heel cup 2. The heel sole unit 40 can include its own midsole layer 41 and an outsole layer 44 to provide additional friction and cushioning in the Z-direction. The outsole layer 44 may include suitable profile elements 42 for engaging the ground. The heel sole unit 40 depicted in FIG. 3 includes an optional central recess 43. The central recess 43 reduces the weight of the heel sole unit 40. The central recess 43 further reduces the danger that pebbles or dirt might get jammed between the heel sole unit 40 and the lower sole body 30, thereby impairing a return of the heel sole unit 40 into a non-deflected position. Should such a contamination actually arise, the central recess 43 also facilitates removal of the contamination. Finally, the central recess 43 also increases the decoupling of the heel sole unit 40 and thereby further adds to the intended function of the sole.

The various components of the sliding element 1 can be manufactured by, for example, injection molding or extrusion. Extrusion processes may be used to provide a uniform shape, such as a single monolithic frame. Insert molding can then be used to provide the desired geometry of, for example, the recesses 5 and slits 4, or the slits 4 could be created in the desired locations by a subsequent machining operation. Other manufacturing techniques include melting or bonding additional portions. For example, the recesses 5 may be adhered to the lower heel cup 2 with a liquid epoxy or a hot melt adhesive, such as ethylene vinyl acetate (EVA). In addition to adhesive bonding, portions can be solvent bonded, which entails using a solvent to facilitate fusing of the portions to be added to the sole. The various components can be separately formed and subsequently attached or the components can be integrally formed by a single step called dual injection, where two or more materials of differing densities are injected simultaneously.

The various components can be manufactured from any suitable polymeric material or combination of polymeric materials, either with or without reinforcement. Suitable materials include: polyurethanes, such as a thermoplastic polyurethane (TPU); EVA; thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12 , which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example natural or synthetic rubber. Other suitable materials will be apparent to those skilled in the art.

FIG. 4 depicts an exploded view of one embodiment of a shoe sole 50 for an article of footwear 48 (see FIG. 5) in accordance with the invention. The article of footwear 48 can include any type of upper 51, conventional or otherwise (not shown, but see FIG. 5). In the embodiment shown in FIG. 4, the sliding element 1 is arranged in the heel area 52; however, an additional or alternative arrangement in the forefoot area 54 or the midfoot area 56 is also possible.

The components of the sliding element 1 may be arranged between a lower sole body 30 and an upper sole body 31 of the midsole. The lower sole body 30 and the upper sole body 31 may be three-dimensionally shaped to correspond to any adjacent component of the sliding element 1 and to allow, therefore, for positively anchoring the sliding element 1 in the shoe sole 50 with a positive fit.

Apart from the discussed integration into the shoe sole 50 between the lower sole body 30 and the upper sole body 31, the upper heel cup 3 may alternatively be arranged directly adjacent to the foot by using, if desired, a sock liner. Further, it is possible to manufacture the upper heel cup 3 other than as a separate component. Instead, the upper heel cup 3 could already be integrated into one of the lower sole body 30 and the upper sole body 31 during manufacture by, for example, the aforementioned dual injection molding or similar production techniques.

Referring still to FIG. 4, the upper heel cup 3 may have, on the lateral side 57 and on the medial side 59, an extension 6 extending into the midfoot area 56 of the shoe sole 50. In alternative embodiments, the extension 6 may be arranged only on one side or in the center of the sole 50. The upper heel cup 3, therefore, additionally contributes to the stabilization of the overall shoe sole 50 and determines, similar to a torsion element, the movability of the heel area 52 relative to the forefoot area 54. Moreover, the upper heel cup 3 simultaneously supports the arch of the foot in the midfoot area 56. The exact design can be varied to suit a particular application.

The components of the sliding element 1 in the shoe sole 50 may also be at least partially encapsulated by a collar 60. Similar to the seal 20, the collar 60 prevents the function of the sliding element 1 from being impaired by penetrating dirt. The collar 60 may be transparent so that the interior constructional elements are visible.

FIG. 5 depicts a cross-sectional view of one embodiment of a shoe sole 50 for an article of footwear 48 in accordance with the invention. The article of footwear 48 can include any type of upper 51. As shown, one or more spring elements 9 may be arranged, as described above, between the lower heel cup 2 and the upper heel cup 3. Moreover, as described above, a seal 20 may encompass the lower heel cup 2 and the upper heel cup 3, and a separate heel sole unit 40 may be arranged below the lower heel cup 2. Also as shown, the lower heel cup 2 and the upper heel cup 3 are at least partially in contact.

Figure 7:
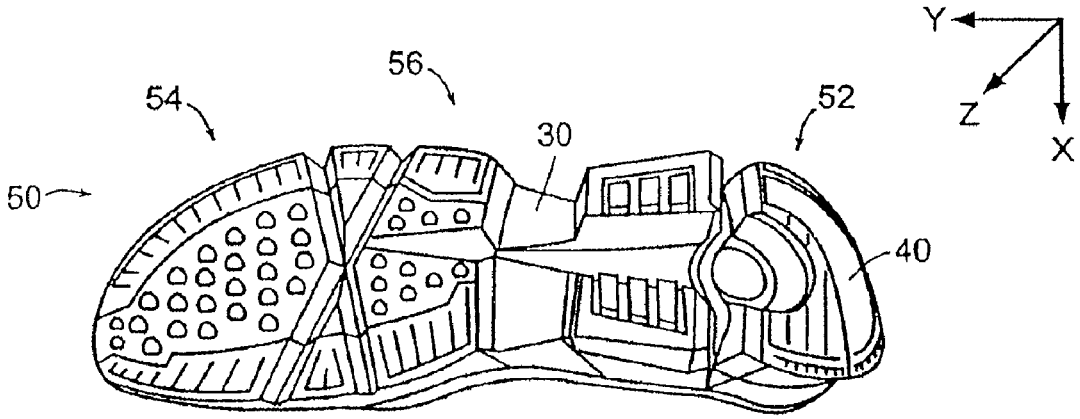
FIG. 7 is a schematic perspective bottom view of the shoe sole of FIG. 4 in an assembled state.

FIG. 7 illustrates a specific function that is obtained by arranging the sliding element 1 inside a shoe sole 50. As shown, the heel area 52 of the shoe sole 50 is divided into two parts, the lower sole body 30 and the separate heel sole unit 40, which is decoupled from the rest of the sole 50. The separate heel sole unit 40 can therefore move in several dimensions relative to the lower sole body 30. As indicated by the different arrows, not only is a turning movement to the rear and above (i.e., the Y- and Z-directions) possible, but a tilting to the medial and lateral side (i.e., the X- and Z-directions) is also possible. The degrees of freedom of this cushioning movement of the heel sole unit 40 are only limited by the above discussed spherical shape of the lower heel cup 2 and the upper heel cup 3. This multidimensional cushioning along an arbitrary trajectory on the spherical surface of the lower heel cup 2 and the upper heel cup 3 noticeably improves the properties of the shoe during ground contact with the heel, in particular in the above described situations with inclined ground surfaces.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. An article of footwear comprising:

an upper; and a sole assembly coupled to the upper, the sole assembly comprising a sliding element, the sliding element comprising:

a first plate having an upper surface and a lower surface that extend substantially an entire length and an entire width of the sole of the article of footwear, wherein a heel cup extends from the upper surface of the first plate; and a second plate having an upper surface and a lower surface, the upper surface of the second plate coupled to the lower surface of the first plate such that the second plate is configured to slide relative to the first plate in any arbitrary direction.

2. The article of footwear of claim 1, wherein the sole assembly further comprises a midsole and an outsole.

3. The article of footwear of claim 2, wherein the midsole comprises a first portion coupled to the lower surface of the first plate and a second portion coupled to the lower surface of the second plate.

4. The article of footwear of claim 3, wherein the first portion and the second portion are discrete portions of the midsole and capable of relative movement therebetween.

5. The article of footwear of claim 1, wherein the second plate slides relative to the first plate in response to an impact between the article of footwear and a ground surface.

6. The article of footwear of claim 1, wherein the first plate is configured to provide support to at least a portion of a wearer's foot.

7. The article of footwear of claim 1, further comprising an elastic element coupling the first plate and the second plate.

8. The article of footwear of claim 7, wherein the elastic element provides a restoring force to the second plate subsequent to a movement of the second plate relative to the first plate.

9. The article of footwear of claim 1, wherein the first plate is coupled to the second plate at a portion of the first plate corresponding to at least one of a heel area, a forefoot area, and a midsole area of the sole assembly.

10. The article of footwear of claim 1, wherein sliding surfaces of the first plate and the second plate comprise low friction material.

11. An article of footwear comprising:

an upper; and a sole assembly coupled to the upper, the sole assembly comprising a sliding element, the sliding element comprising:

a first plate having an upper surface and a lower surface that extend from a rear area into a midfoot area of the article of footwear, wherein a heel cup extends from the upper surface of the first plate; and a second plate having an upper surface and a lower surface, the upper surface of the second plate coupled to the lower surface of the first plate such that the second plate is configured to slide relative to the first plate in any arbitrary direction.

12. The article of footwear of claim 11, wherein the upper surface and the lower surface of the first plate extend into a forefoot area of the article of footwear.

13. The article of footwear of claim 11, wherein the sole assembly further comprises a midsole and an outsole.

14. The article of footwear of claim 13, wherein the midsole comprises a first portion coupled to the lower surface of the first plate and a second portion coupled to the lower surface of the second plate.

15. The article of footwear of claim 11, wherein the second plate slides relative to the first plate in response to an impact between the article of footwear and a ground surface.

16. The article of footwear of claim 11, wherein the first plate is configured to provide support to at least a portion of a wearer's foot.

17. The article of footwear of claim 11, further comprising an elastic element coupling the first plate and the second plate.

18. The article of footwear of claim 17, wherein the elastic element provides a restoring force to the second plate subsequent to a movement of the second plate relative to the first plate.

19. The article of footwear of claim 11, wherein the first plate is coupled to the second plate at a portion of the first plate corresponding to at least one of a heel area, a forefoot area, and a midsole area of the sole assembly.

* * * * *